US011447967B2

(12) United States Patent
Mors et al.

(10) Patent No.: US 11,447,967 B2
(45) Date of Patent: Sep. 20, 2022

(54) ARTICULATED BOOM WITH BOOM SEGMENTS AND METHOD FOR PRODUCING A BOOM SEGMENT

(71) Applicant: Schwing GmbH, Herne (DE)

(72) Inventors: Mark Mors, Bergkamen (DE); Christoph Sacken, Essen (DE)

(73) Assignee: Schwing GmbH, Herne (DE)

( * ) Notice: Subject to any disclaimer, the term of this patent is extended or adjusted under 35 U.S.C. 154(b) by 125 days.

(21) Appl. No.: 16/825,700

(22) Filed: Mar. 20, 2020

(65) Prior Publication Data

US 2020/0298298 A1 Sep. 24, 2020

(51) Int. Cl.
*E04G 21/04* (2006.01)
*B66C 23/68* (2006.01)

(52) U.S. Cl.
CPC ..... *E04G 21/0445* (2013.01); *B66C 23/68* (2013.01)

(58) Field of Classification Search
CPC ..... E04G 21/0445; E02F 3/38; B66C 23/64; B66C 23/68; B66C 23/701
See application file for complete search history.

(56) References Cited

U.S. PATENT DOCUMENTS 4,038,794 A * 8/1977 Young ..... B66C 23/701 52/118
6,499,612 B1 * 12/2002 Harrgington ..... B66C 23/701 212/270
2006/0277859 A1 * 12/2006 Egli ..... E06B 3/2634 52/843
2008/0292443 A1 * 11/2008 Nose ..... B23K 31/02 414/722
2010/0119344 A1 5/2010 Nabata et al.
2013/0020274 A1 * 1/2013 Munuswamy ..... B66C 23/04 212/347
2015/0336778 A1 * 11/2015 Ditzler ..... A01D 34/866 248/68.1
2017/0254101 A1 * 9/2017 Segschneider ..... E04G 21/0418
2020/0370314 A1 * 11/2020 Muller ..... B66C 23/64

FOREIGN PATENT DOCUMENTS

DE 19644410 A1 4/1998
DE 102014012493 A1 3/2016
DE 102017223240 A1 6/2019
WO WO-02064485 A2 * 8/2002 ..... B66C 23/701

* cited by examiner

*Primary Examiner* — Sang K Kim
*Assistant Examiner* — Nathaniel L Adams
(74) *Attorney, Agent, or Firm* — Faegre Drinker Biddle & Reath LLP

(57) ABSTRACT

An articulated boom of a large manipulator includes a plurality of boom segments connected to one another via articulated joints. At least one of the boom segments has a welded assembly forming a box profile in which an upper belt and a lower belt are connected to one another via lateral web plates. At least one of the web plates, the upper belt, and/or the lower belt is formed at least by one sheet metal section, which has at least one bending running essentially in a longitudinal direction of the boom segment. The at least one bending ends at a distance from an end of the sheet metal section so that the end of the sheet metal section is unbent.

14 Claims, 10 Drawing Sheets

ARTICULATED BOOM WITH BOOM SEGMENTS AND METHOD FOR PRODUCING A BOOM SEGMENT

CROSS-REFERENCE TO RELATED APPLICATION

Figure 1:
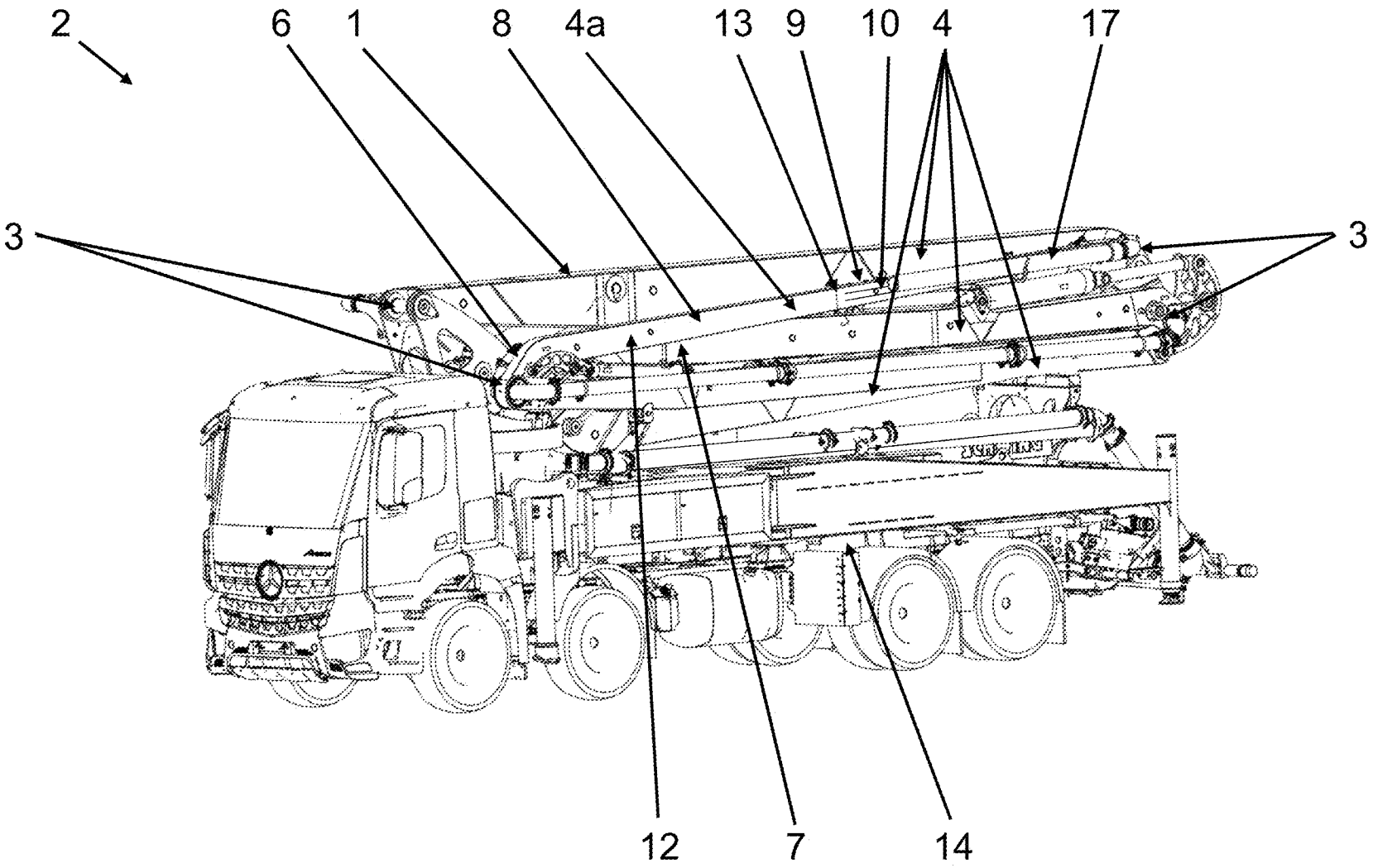

This application claims priority to German Patent Application No. 10 2019 107 456.8, filed Mar. 22, 2019, which is herein incorporated by reference in its entirety.

The invention relates to an articulated boom of a large manipulator, in particular of a truck-mounted concrete pump, with a plurality of boom segments connected to one another via articulated joints, at least one of the boom segments having a welded construction in the form of a box profile in which an upper belt and a lower belt are connected to one another via lateral web plates, and a method for producing a boom segment of such an articulated boom.

Articulated booms, particularly for truck-mounted concrete pumps and other types of large manipulators, are known from the state of the art in a large number of designs (see e.g. DE 196 44 410 A1). The requirements for the boom length, i.e. the range of the slewing articulated booms, are constantly increasing. In order to keep the self-weight of the boom segments and thus of the articulated booms as low as possible, the known boom segments are made of hollow profiles. These hollow profiles are usually welded constructions in which an upper belt and a lower belt are connected to each other via lateral web plates. The boom segments can also be designed as a U-profile at least in partial areas, e.g. at points where a hydraulic cylinder dips into the boom segment. In order to be able to further save weight when forming hollow profiles or U-profiles on the boom segments, efforts are still being made to reduce the sheet metal thicknesses of the upper and lower belt and the lateral web plates to a necessary minimum. With thin-walled welded structures, however, distortions typically occur during production. Such production-related distortions can seldom be eliminated completely and usually only at great expense in terms of time. It is difficult to predict distortions, which complicates their elimination. These distortions often occur on thin, non-stiffened sheet metals as a result of the interaction of longitudinal, transverse and angular shrinkage during cooling of the components after welding. It is known that in order to avoid distortions, the sheet metals are clamped more tightly during the welding process, which can lead to non-visible stresses in the sheet metals, or a change in the welding process is made. For the production of light boom segments from thin-walled sheet metals, a change in the welding process is costly, since the MAG welding process is generally used in boom construction, which is usually used for sheet metals with a thickness of 3 to 12 mm. For example, in boom construction, 3 mm thick sheet metals are often still used where, for reasons of rigidity and strength, even lower sheet thicknesses would be sufficient. This means that a lower sheet metal thickness is not required in the manufacture of articulated booms, as these thinner sheet metals are difficult to weld using the MAG welding process normally used. Changing the welding process, for example to the WIG welding process, which is more suitable for lower sheet metal thicknesses, is too cost-intensive due to the low output in boom construction and also takes considerably more time and would make it necessary to change the plant to another welding process.

Therefore, it is the task of the invention to specify an improved articulated boom made of boom segments which, due to a lower self weight, allows for a higher range and which, at the same time, can be manufactured easily, quickly and without errors using conventional manufacturing methods. In addition, it is the task of the invention to specify a manufacturing process which enables a simplified production of a boom segment for such an articulated boom.

This task is solved by an articulated boom with the features of claim 1 as well as by a method for the production of a boom segment with the features of claim 11.

In that at least one of the web plates and/or the upper belt and/or the lower belt is formed by at least one sheet metal section which has at least one bending extending substantially in the longitudinal direction of the boom segment, the at least one bending ending at a distance from the end of the section, so that the end of the sheet metal section is unbent, a reduction of distortions of the thin-walled sheet metals in the boom construction of the articulated boom can be achieved in a simple manner. The fact that the at least one bend ends at a distance from one end or both ends of the sheet metal section, so that the end of the sheet metal section is unbent, means that a straight transition to the following sheet metal section can be formed with the unbent end of the sheet metal section. This makes it easier to position the sheet metal sections and weld the sheet metal sections to form a transition between the sheet metal sections, especially when welding the sheet metal section with a bend to an unbent sheet metal section. This allows transitions between the sheet metal sections to be easily produced using the butt welding process.

With such a bending running essentially in the longitudinal direction of the boom segment, the sheet metal thicknesses used can be further reduced in order to save self weight on the boom segments and thus enable a greater reach of the articulated boom. The bending of the sheet metal sections forming the web plates, the upper belt or the lower belt can be used to easily prevent distortions from forming in the welded construction during cooling, especially after the welding process. The bending running in the longitudinal direction of the boom segment effectively prevents the formation of distortions due to the welding process.

Advantageous designs and further developments of the invention result from the dependent claims. It should be noted that the features listed individually in the claims can also be combined with each other in any technologically meaningful way and thus show further embodiments of the invention.

According to an advantageous embodiment of the invention, it is provided that the at least one bending has a simple V-shaped profile cross-section. The simple V-shaped profile cross-section provides an easily producible bending geometry which effectively prevents the formation of distortions in the sheet metal section of the boom segment provided with it. The bending angle of the V-shaped profile cross-section should preferably be between 160 and 176° between the two bending sections. The bending radius of the V-shaped profile cross-section is preferably relatively small.

Particularly advantageous is an embodiment which provides that the at least one bending has an arc-shaped profile cross-section. With an arc-shaped cross-section, a uniformly curved sheet metal contour is given which can be easily produced and prevents the formation of distortions in the sheet metal section of the boom segment provided with it. The radius of the arc-shaped cross-section should be at least 10 cm.

A particularly advantageous embodiment of the invention refers to the fact that the at least one bending is directed into the interior of the box profile or outwards out of the box profile. Neither with the orientation of the bending into the interior of the box profile nor outwards the cross-section of the boom segment is significantly changed, so that the dimensions hardly change and existing constructions and attachments can also be converted to bent web or belt sheet metals without changes.

An advantageous embodiment of the invention provides that the sheet metal section has at least two bendings running essentially in the longitudinal direction of the boom segment. With several bendings running essentially in the longitudinal direction of the boom segment, the risk of distortions can be further minimized, since the individual bendings running in the longitudinal direction of the boom segment can be brought closer to the welds connecting the web plates with the upper belt and the lower belt.

Particularly advantageous is an embodiment that provides for the at least two bendings to be aligned along the longitudinal direction of the boom segment. This further reduces the tendency of the metal sheed sections to form distortions. Preferably, the at least two bendings converge towards the top of the boom segment, particularly the tip section. This makes it possible to produce a particularly lightweight last boom segment where the sheet metal used is less prone to the formation of distortions.

An advantageous embodiment provides for the at least two bendings to be directed into the interior of the box profile or outwards from the box profile, or at least one of the at least two bendings to be directed into the interior of the box profile and at least one outwards from the box profile. Neither with the alignment of the bending into the inside of the box profile nor outwards the cross-section of the boom segment is significantly changed, so that the dimensions hardly change and existing constructions and attachments can be converted to bent web or belt sheet metals without changes. With at least one bending into the inside of the box profile and at least one bending outwards from the box profile, complex profile geometries can be introduced into the sheet metal sections by means of bending, so that distortions can be reduced in a targeted manner.

According to a preferred embodiment of the invention, it is provided that a profile angle of the box profile in the area of the at least one bending between one of the web plates and the upper belt and/or between one of the web plates and the lower belt is formed offset to a right angle between 2 and 15 degrees, preferably 4 to 10 degrees. With the offset of the profile angle, the sheet metal section provided with a longitudinally extending bending is oriented at a special angle which provides a high stability of the boom segment and at the same time reduces the formation of distortions during the welding process. For an effective reduction of distortions, a tilt angle of approx. 5 degrees for the tilt running essentially in longitudinal direction of the boom segment is already sufficient to achieve a corresponding effect.

Particularly advantageous is an embodiment which provides that the web plate and/or the upper belt and/or the lower belt is made of at least two sheet metal sections of different thickness, the sheet metal sections being connected to one another by a transition, at least the sheet metal section with the smaller thickness having at least one bending extending substantially in the longitudinal direction of the boom segment. The use of sheet metal sections of different thicknesses permits a weight-and stiffness-optimized design of the boom segments, wherein the bending in the sheet metal section with the smaller thickness running substantially in the longitudinal direction of the boom segment effectively prevents distortions in this sheet metal section. The sheet metal sections of different thickness are preferably welded together by means of butt welding to form the transition.

A particularly advantageous embodiment of the invention provides that at least the last, preferably only the last, boom segment of the articulated boom forming the tip section has a bending running essentially in the longitudinal direction of the boom segment. Especially in the construction of the tip boom section, thinner sheet metals can be used due to the bending running essentially in the longitudinal direction of the boom segment, without these tending to form distortions during welding. Due to the relatively low moment that has to be absorbed by the tip boom section due to the end hose etc., the use of thinner sheet metals is particularly well possible here, whereby a weight reduction on the tip boom section allows further weight reductions on the remaining boom segments, since the moment exerted by the tip boom section is reduced. In addition, the weight reduction allows an increase of the boom length.

Furthermore, a subject of the invention is a method for producing a boom segment of an articulated boom of a large manipulator, in particular a truck-mounted concrete pump, as described above and in more detail below. The method provides that a box profile is produced by welding an upper belt and a lower belt with lateral web plates, wherein prior to welding at least one bending is introduced into at least one sheet metal section of the upper belt, lower belt and/or web plates, which bending extends substantially in the longitudinal direction of the boom segment, the bending ending at a distance from the end of the sheet metal section so that the end of the sheet metal section is unbent.

With the introduction of the essentially longitudinally extending bending in the sheet metal section, the tendency of the sheet metal section to form distortions, especially after the welding process, can be significantly reduced, as explained above. In this way, sheet metal sections with a lower thickness can be welded together simply to form the box profile without distortions occurring as the welded structure cools down. Because the at least one bending ends at a distance from one end or both ends of the sheet metal section, so that the end of the sheet metal section is always unbent, a straight transition to the following sheet metal section can be easily formed with the unbent end of the sheet metal section.

A particularly advantageous embodiment of the method is, that the at least one bending is introduced into the sheet metal section by a forming process, i.e. die bending or folding or free bending or stamping or rolling or deep drawing or similar. The introduction of the bending by means of one of these manufacturing processes is simple and can be carried out excellently before welding the upper belt, lower belt and the lateral web plates. Further features, details and advantages of the invention are given in the following description and in the drawings which show examples of the invention. Objects or elements corresponding to each other are marked with the same reference signs in all figures.

Figure 2:
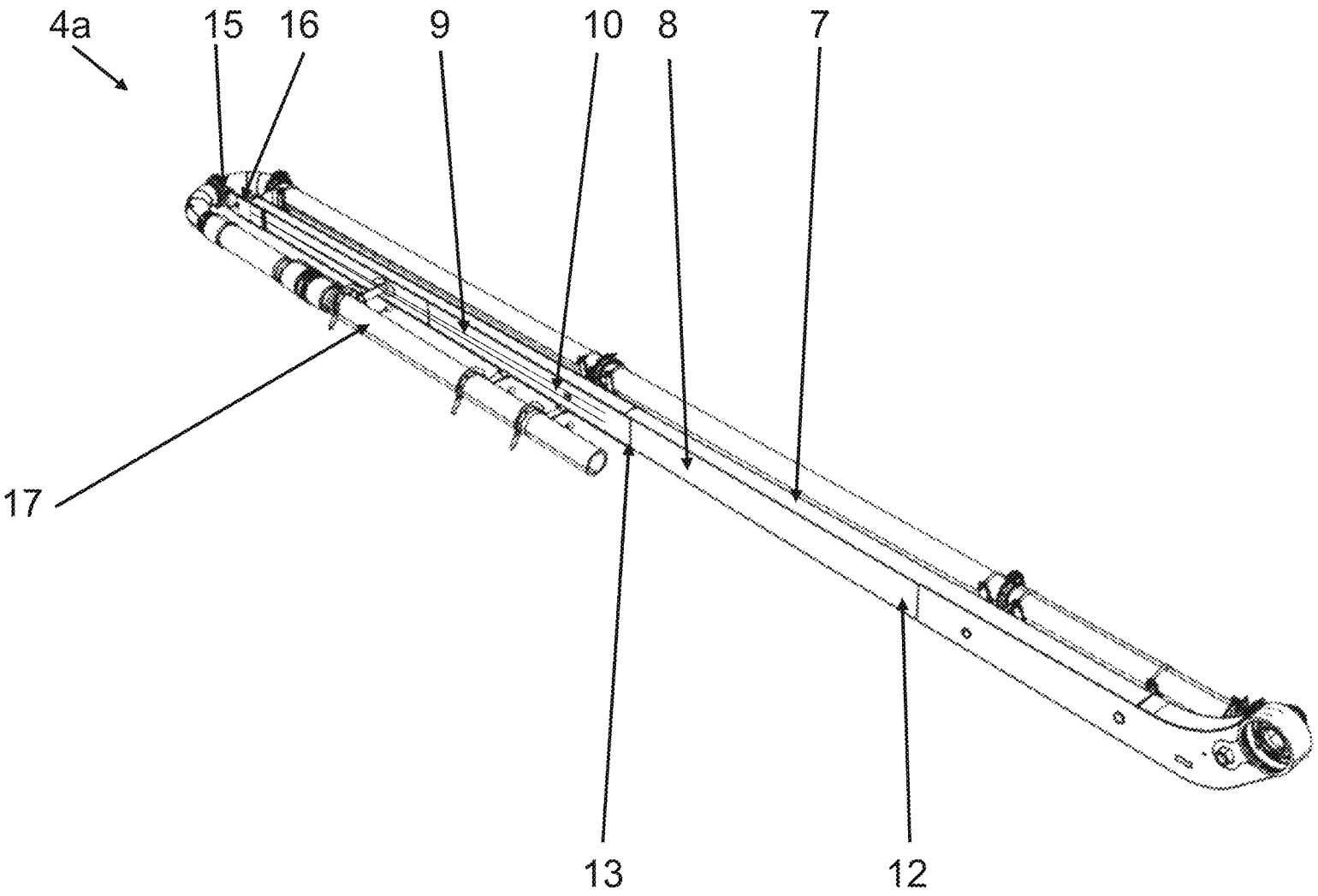
Figure 3:
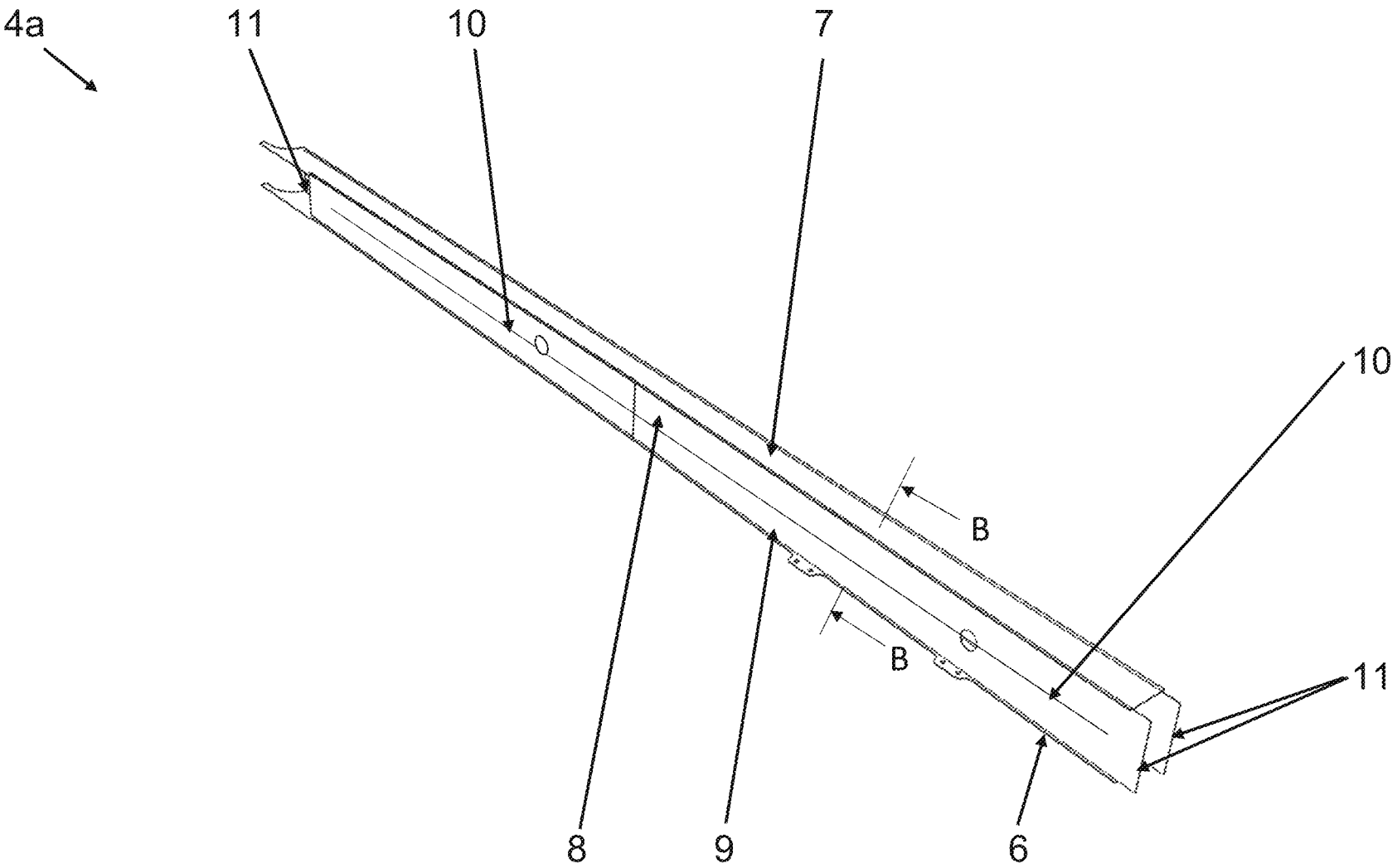
Figure 4:
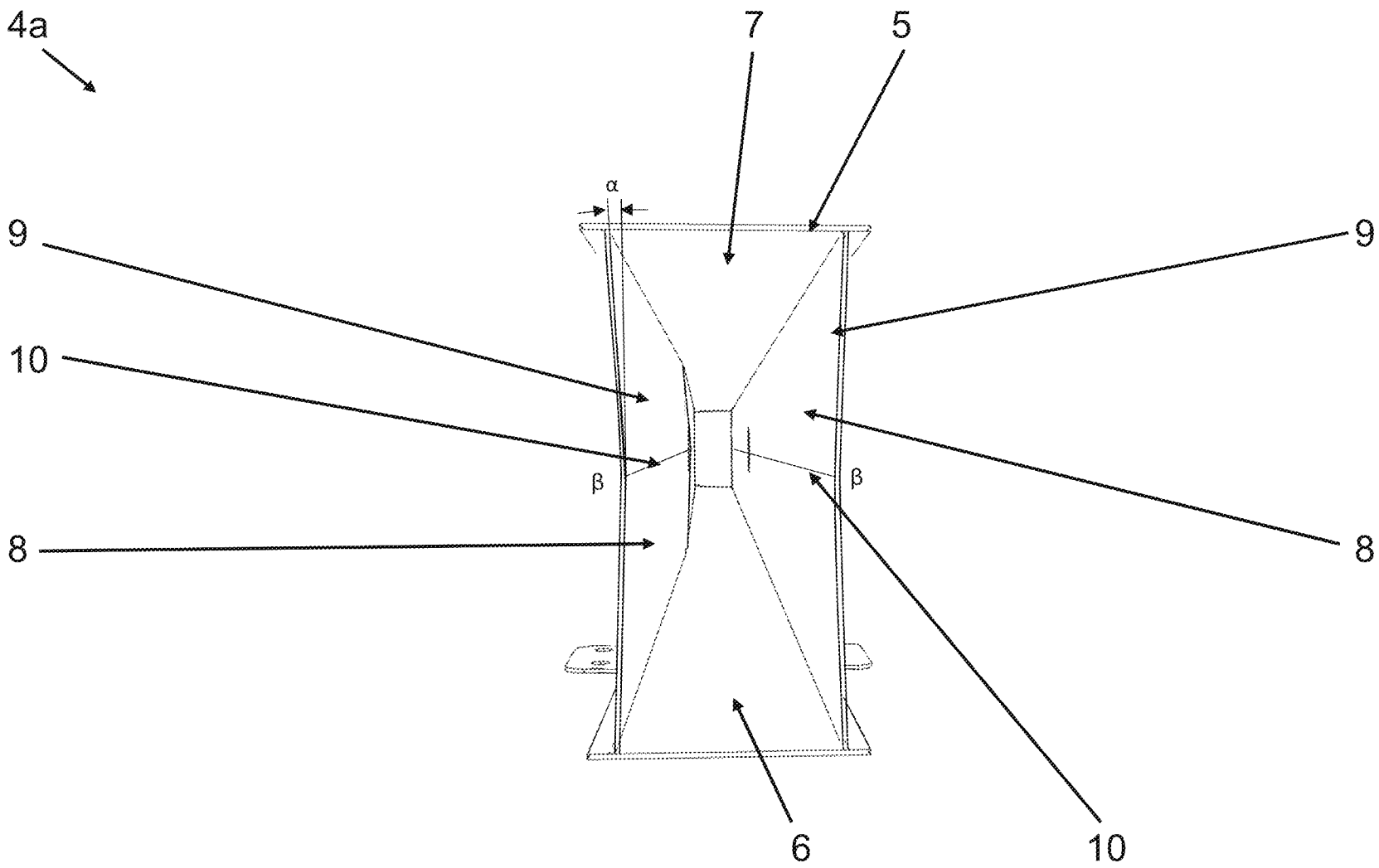
Figure 5:
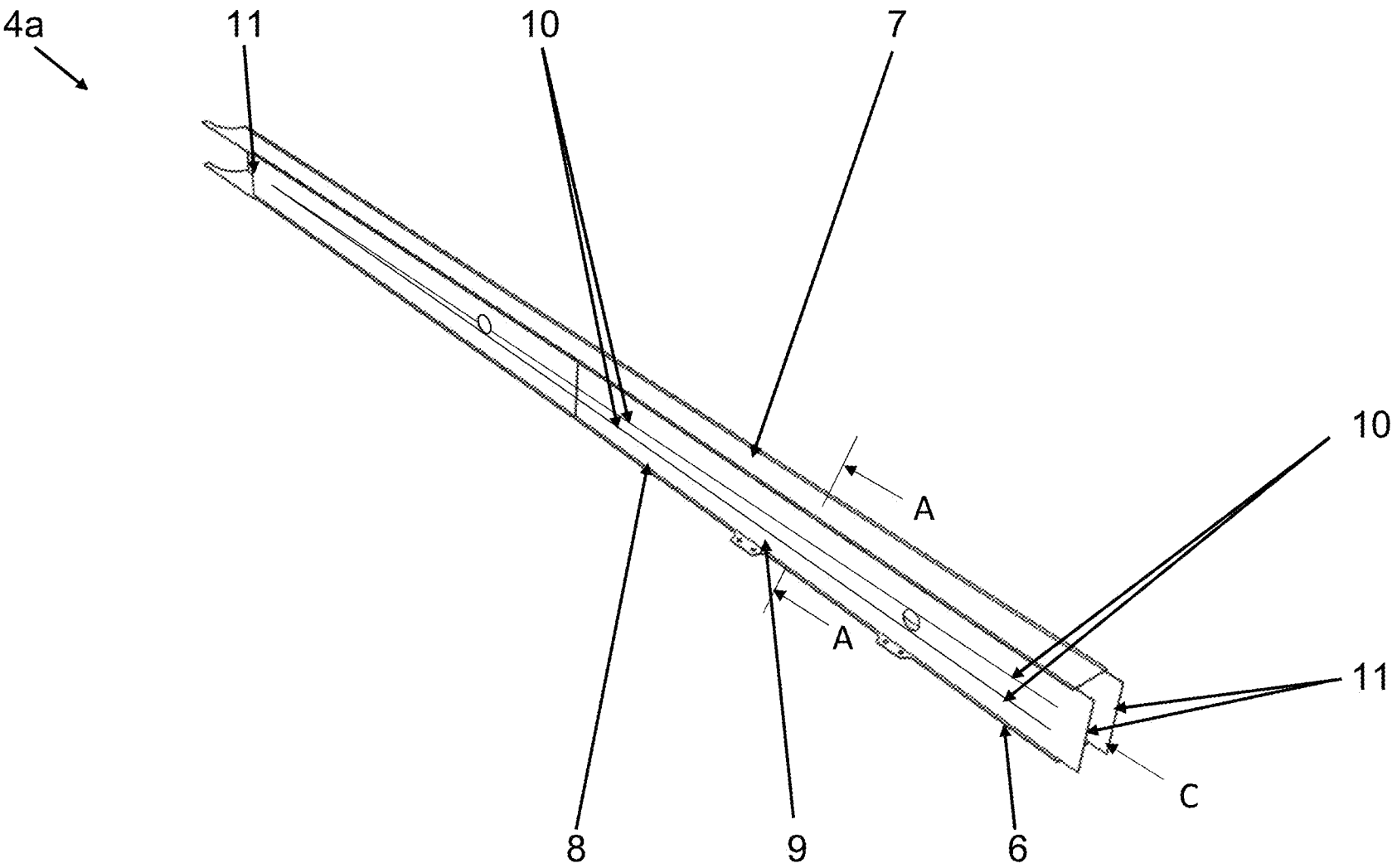
Figure 6:
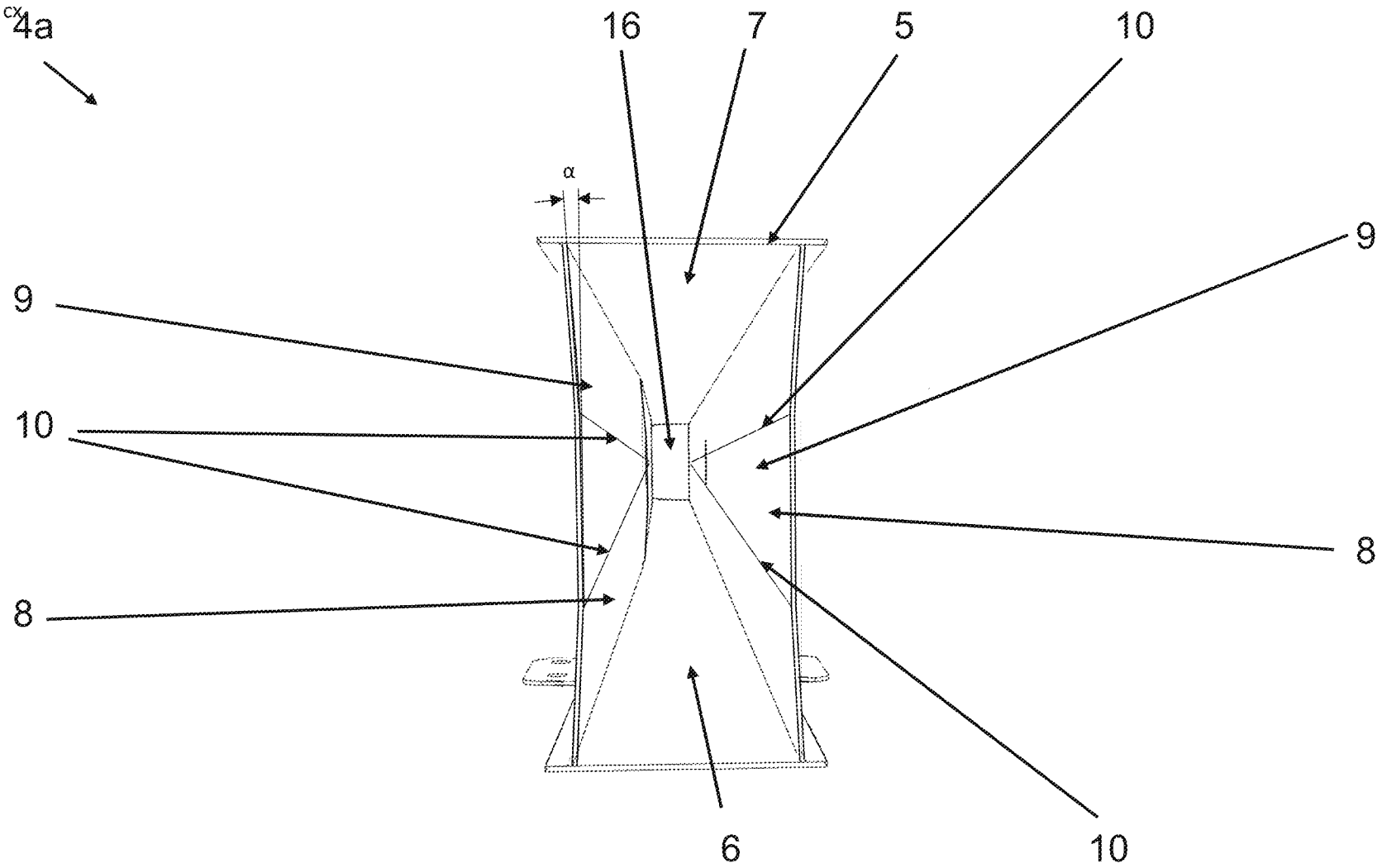
Figure 7:
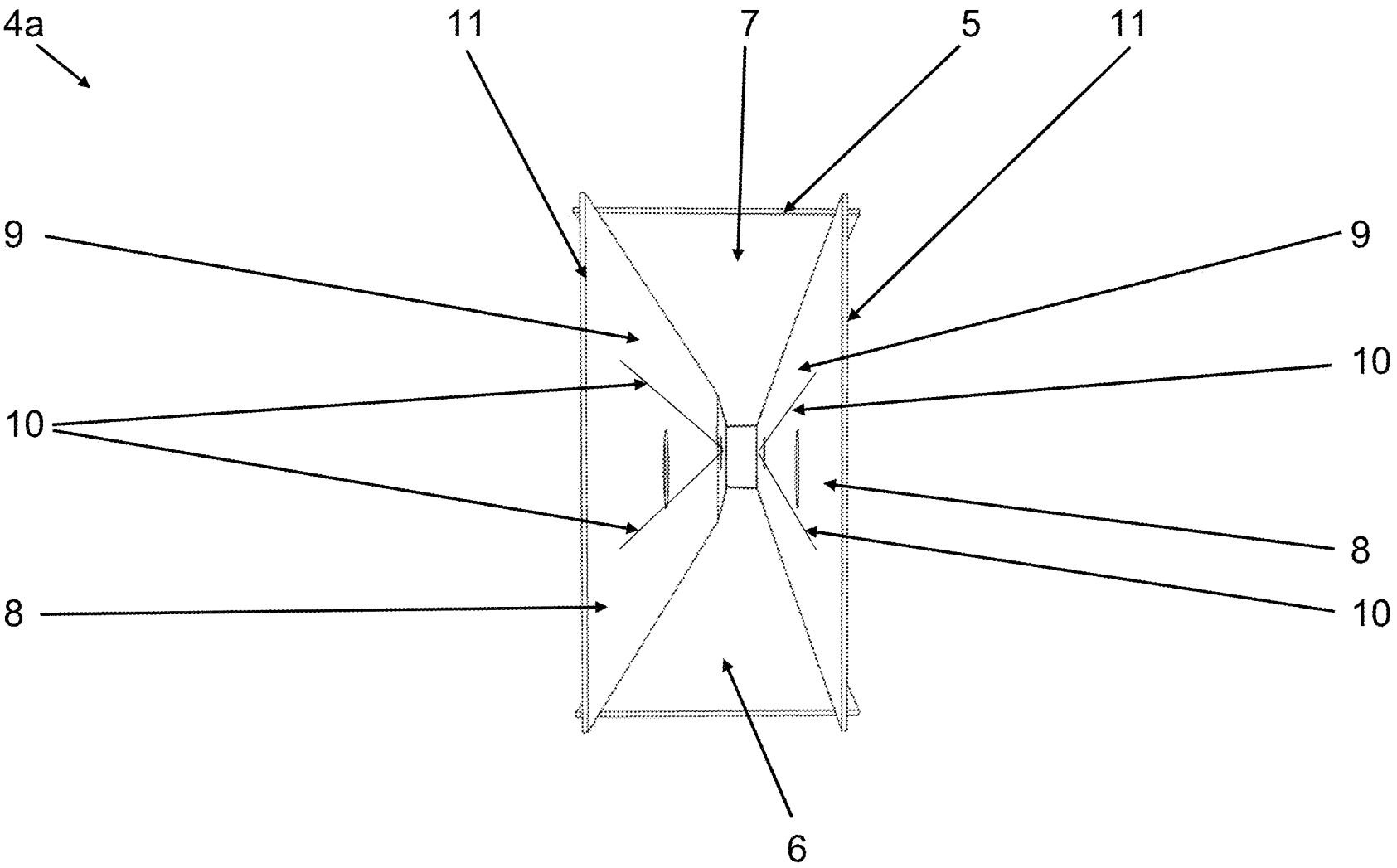
Figure 8:
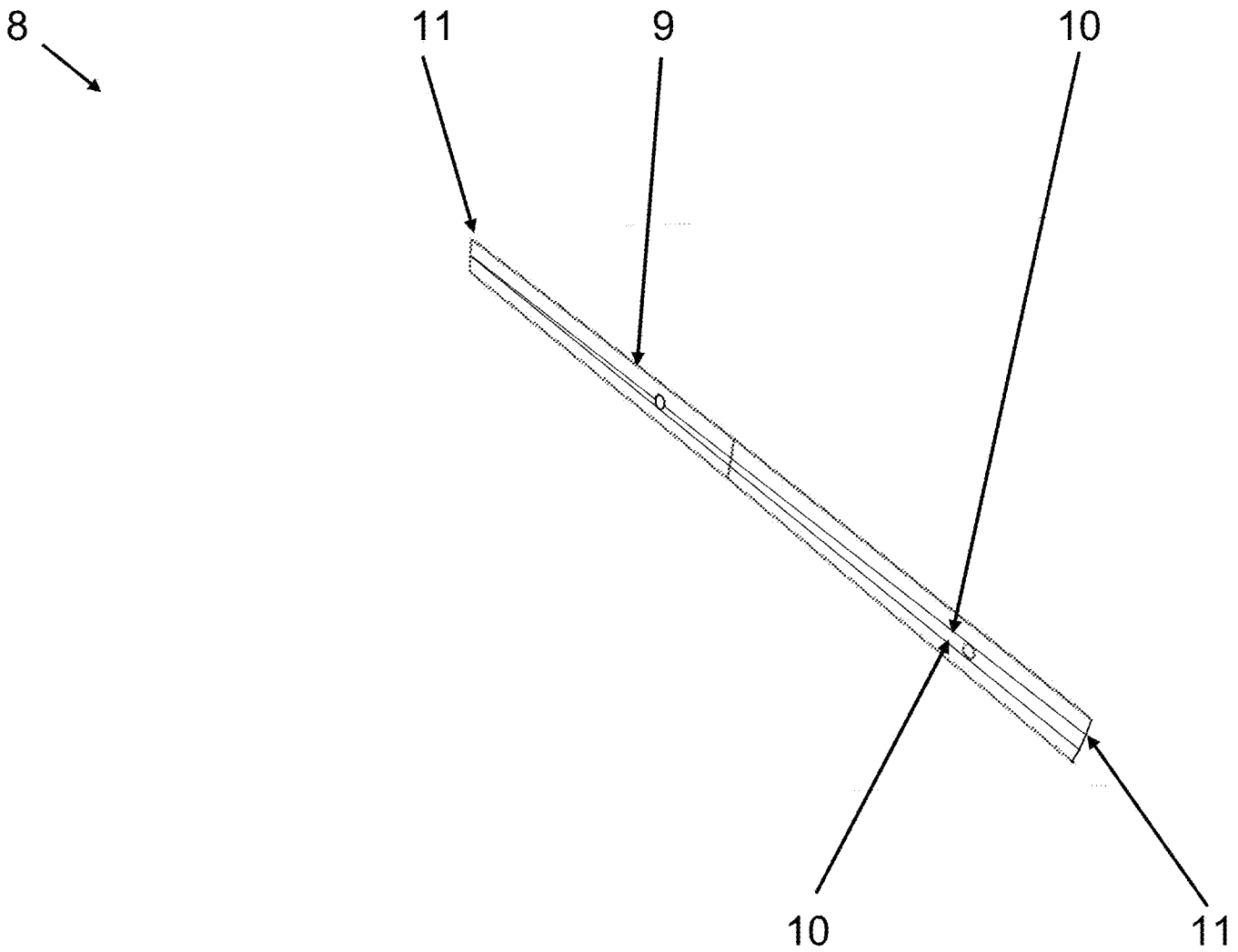
Figure 9:
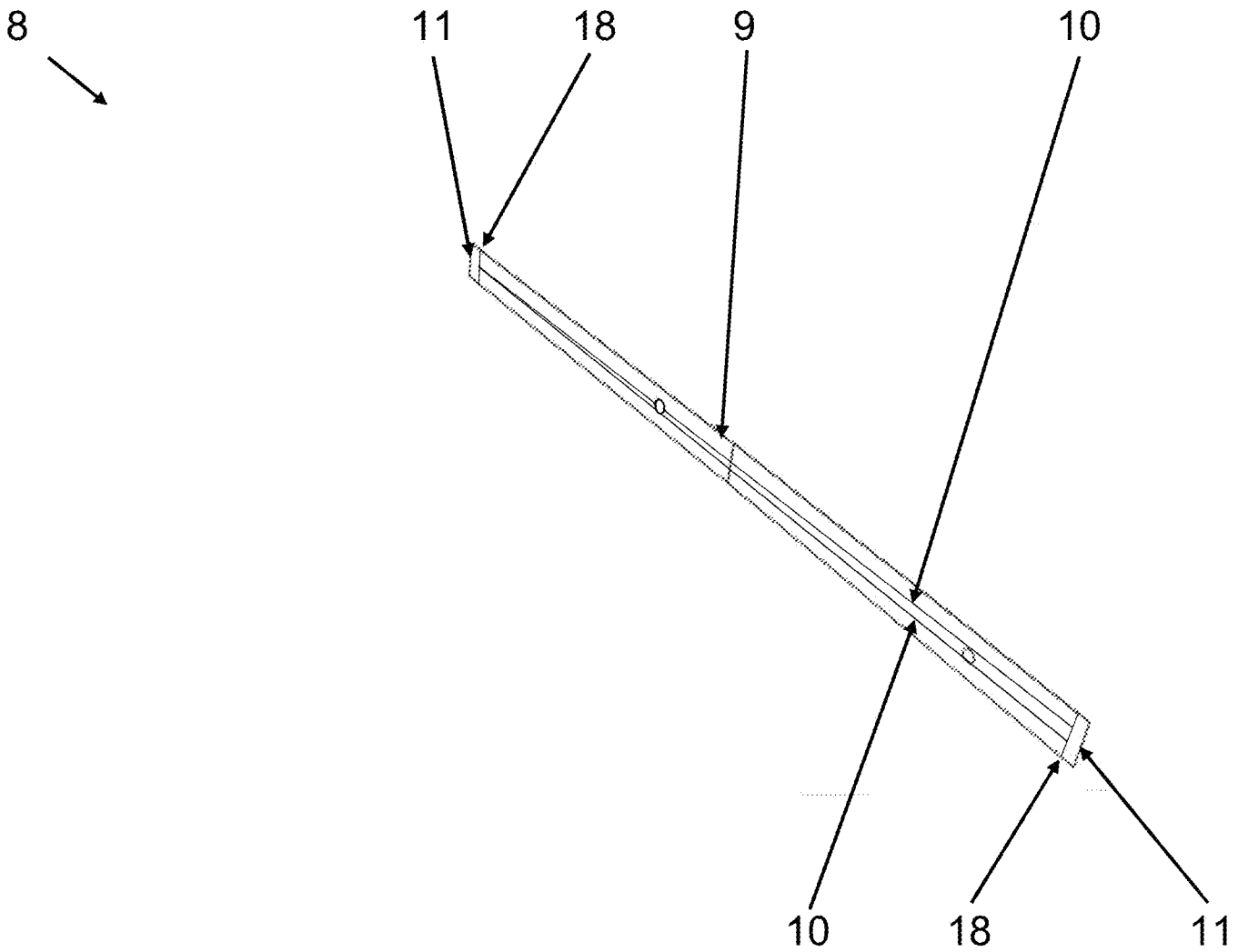
Figure 10:
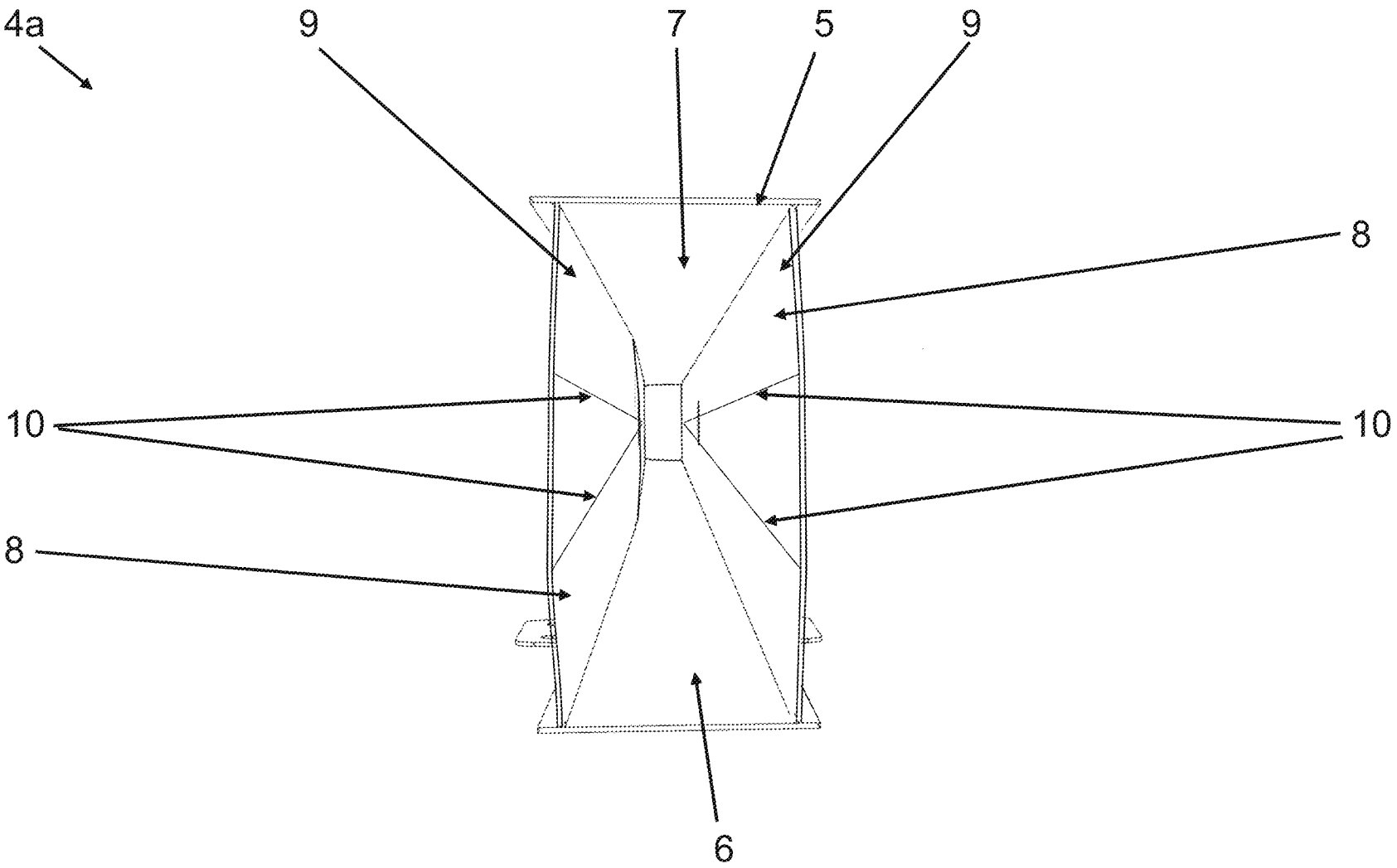

In the drawing:

FIG. 1 shows a large manipulator with an articulated boom according to the invention, FIG. 2 shows a segment of the articulated boom, FIG. 3 shows a part of the boom segment with a single bending, FIG. 4 shows a box profile with single bending, FIG. 5 shows a part of the boom segment with a double bending, FIG. 6 shows a box profile with double bending, FIG. 7 shows an end area of the boom segment, FIG. 8 shows a web plate with a double bending, FIG. 9 shows a web plate with double longitudinal and cross bending and FIG. 10 shows a box profile with outwardly directed bendings FIG. 1, marked with the reference sign 1, shows an articulated boom according to the invention. The articulated boom 1 is mounted on a chassis 14 of a large manipulator 2 designed as a truck-mounted concrete pump with the articulated boom 1 folded up. The articulated boom 1 has a plurality of boom segments 4, 4*a* connected by articulated joints 3, which can be unfolded for operation of the large manipulator 2. The boom segments 4, 4*a* are designed as box profiles 5 (FIGS. 4, 6, 10), manufactured as welded constructions with an upper belt 6, a lower belt 7 and two lateral web plates 8. In the design example shown here, the last boom segment, i.e. the tip boom section 4*a* of the articulated boom 1, is provided with a special sheet metal section 9. This sheet metal section 9, which forms the web plate 8 of boom tip section 4*a*, has two bendings 10 running essentially in the longitudinal direction of boom segment 4*a*. These bendings 10 of the web plate 8 prevent the formation of distortions during the welding process. As shown in FIG. 1, the web plate 8 of the last boom segment 4*a* is made of two sheet metal sections 9, 12 of different thicknesses, which are connected by a transition 13. This transition 13 is achieved by a butt welding process which joins the two sheet metal sections 9, 12 of different thicknesses to form web plate 8. To prevent distortions in the sheet metal section 9 with the smaller thickness, the bendings 10 running in the longitudinal direction of boom segment 4*a* are provided in this sheet metal section 9. As an alternative to the two sheet metal sections 9, 12, the web plate 8 can also be formed from a single sheet metal section with one or more bendings 10.

FIG. 2 shows a detailed view of the last boom segment 4*a* of the articulated boom 1 according to FIG. 1, whereby the boom segment 4*a* is visible from below, so that the lower belt 7 is on the upper side. FIG. 2 further shows that the web plate 8 of the boom segment 4*a* is formed by the two differently thick sheet metal sections 9, 12, which are connected by means of the transition 13. The bendings 10 running in longitudinal direction of the tip boom segment 4*a* are only arranged in the sheet metal section 9 with the smaller thickness. The sheet metal section 9 with the smaller thickness forms the web plate 8 of the last boom segment 4*a*, from the transition 13 arranged approximately in the middle of the boom segment 4*a* up to the end hose holder 15 at the boom tip 16. With such a sheet metal section 9 it is already possible to save considerable weight at the last boom segment 4*a*. Because of the relatively small moment which has to be absorbed by tip boom segment 4*a* due to the end hose 17 at the end hose attachment 15, the use of thinner sheet metals is particularly well possible here, whereby a weight reduction at tip boom segment 4*a* allows further weight reductions at the remaining boom segments 4 (FIG. 1), since the moment exerted by tip boom segment 4*a* itself is reduced to the remaining articulated boom 1 (FIG. 1). While the front, thinner sheet metal section 9 of the web plate 8 preferably consists of 2 mm sheet metals, the rear, thicker sheet metal section 12 preferably consists of 3 mm thick sheet metals. As already shown in FIG. 2, the bendings 10 in the sheet metal section 9 end at a distance from the end 11 of the sheet metal section 9, so that the end 11 of the thinner sheet metal section 9 is unbent and allows a simple connection in the transition 13 with the thicker sheet metal section 12 of the web plate 8. The two bendings 10 running essentially in the longitudinal direction of the boom segment 4*a* are aligned along the longitudinal direction of the boom segment 4*a* so that the bendings 10 converge in the web plate 8 at the boom tip 16.

FIG. 3 shows the front section of the boom segment 4*a* as shown in FIG. 3, but here with a single bending 10 in the thinner sheet metal section 9. The single bending 10 in the sheet metal section 9 forming the web plate 8 runs approximately centrally, essentially in the longitudinal direction of the boom segment 4*a* and ends at a distance from the ends 11 of the sheet metal section 9, so that the ends 11 are not bent, as can be seen. The simple bending 10 shown here has a V-shaped profile cross-section, as can also be seen in FIG. 4.

FIG. 4 shows a sectional view through the sectional plane B-B indicated in FIG. 3 through the box profile 5 of boom segment 4*a*. FIG. 4 shows that the bending 10, which is located in the middle of the web plates, has a V-shaped profile cross-section. This profile cross-section is easy to produce and is effective against the formation of distortions in the sheet metal section 9 of boom segment 4*a*, which forms the web plate 8. The bending angle $\beta$ of the V-shaped profile cross-section is between 160 and 176° between the two bending sections, whereby the bending radius of the V-shaped profile cross-section is relatively small, as can be seen. The profile angle $\alpha$ of the box profile 5 in the area of the at least one bending 10 is between the web plate 8 and the upper belt 6 and between the web plate 8 and the lower belt 7 in the case of the single bending 10 preferably between 3 and 10 degrees, to a right angle which starts from the unbent upper belt 6 or the unbent lower belt 7. With this arrangement of the web plates 8 and the upper belt 6 and the lower belt 7, the formation of distortions during the welding process can be effectively prevented. The shown bending 10 into the inside of the box section 5 does not significantly change the geometry or diameter of the boom segment and allows, for example, to use already constructed pipe holders leading through the boom without any design changes being necessary, since the cross-section of the boom segment 4*a* in the box profile 5 is only slightly reduced.

FIG. 5 shows the front part of the boom segment as shown in FIG. 3 with a double bending 10 in the thinner sheet metal section 9. The double bending 10 in the sheet metal section 9 forming the web plate 8 run towards each other in the longitudinal direction of the boom segment 4*a* and meet at the boom tip 16 at boom segment 4*a*. The bendings 10 each end at a distance to the ends 11 of the sheet metal section 9, so that the ends 11 are, as can be seen, unbent. The double bending 10 shown here have a simple V-shaped profile cross-section, as can be seen in FIG. 6.

FIG. 6 provides a sectional view through the sectional plane A-A indicated in FIG. 5 through the box profile 5 of boom segment 4*a*. FIG. 6 shows that the two bendings 10 running essentially in the longitudinal direction of boom segment 4*a* in the sheet metal sections 9 forming the web plate 8 are directed into the interior of the box profile 5. The two bendings 10 converge in the longitudinal direction of the boom segment 4*a* and converge in the area of the boom tip 16. FIG. 6 shows that the bendings 10 arranged on the web plates 8 have a V-shaped profile cross-section. This profile cross-section is easy to produce and is effective against the formation of distortions in the sheet metal section 9 of boom segment 4*a*, which forms the web plate 8. As can be seen, the bending radius of the V-shaped profile cross-section is relatively small. The profile angle $\alpha$ of the box profile 5 in the area of the bendings 10 between the web plate 8 and the upper belt 6 and between the web plate 8 and the lower belt 7 in the case of the double bending 10 of the sheet metal section 9 forming the web plate 8 is preferably between 2 and 15 degrees, to a right angle which starts from the unbent upper belt 6 or the unbent lower belt 7. This arrangement of the web plates 8 and the upper belt 6 and the lower belt 7 effectively prevents the formation of distortions during the welding process. The shown bendings 10 into the inside of the box profile 5 allow the use of already constructed tube holders without the need for constructional changes to them, because the cross-section of the boom segment 4*a* in the box profile 5 is only minimally reduced by the bendings 10. In addition to these bendings 10 with V-shaped profile cross section, curved profile cross sections are also conceivable, where the curve of the profile preferably has a constant radius. The bendings 10 can all be easily inserted into the sheet metal section 9 prior to welding of the boom segment 4*a* by forming processes such as die bending or folding or free bending or embossing or rolling or deep drawing or similar.

FIG. 7 shows a view of the end section of the boom segment 4*a* as shown in FIG. 5 in the indicated position C. In this illustration it can be seen that the ends 11 of the sheet metal section 9 are unbent, i.e. straight continuous, so that an approximately right-angled box profile 5 is given at the end of the partial area, which offers a simple transition 13 (FIG. 2) to the rear partial area of the last boom segment 4*a* (FIG. 2).

FIG. 8 shows a view of the web plate 8 with a double bending 10, whereby here the bendings 10 running essentially in the longitudinal direction of the boom segment 4*a* extend to the end 11 of the sheet metal section 9.

FIG. 9, on the other hand, shows a detailed view of a web plate 8 with a double longitudinal bending 10. Here, the two bendings 10, which are essentially made in the longitudinal direction, run towards each other and end at a distance from the end 11 of the sheet metal section 9. At the end of the bendings 10, which run in the longitudinal direction, cross bendings 18 are made in the sheet metal section, which straighten the end 11 of the sheet metal section 9, so that the end 11 of the sheet metal section 9 is unfolded and enables a simple transition 13 (FIG. 2) to unfolded sheet metal sections 12. (FIG. 2)

FIG. 10 shows a sectional view through the sectional plane A-A indicated in FIG. 5 through the box profile 5 of boom segment 4*a*, whereby the box profile 5 here has outwardly directed bendings 10. The two bendings 10 running essentially in the longitudinal direction of the boom segment 4*a* in the sheet metal sections 9 forming the web plate 8 are directed out of the box profile 5 of the boom segment 4*a*. With the alignment of the bendings 10 outwards from the box profile 5, more rigidity and a higher section modulus of the boom segment 4*a* is achieved, since the cross section of the boom segment 4*a* in the box profile 5 is increased by the outwardly directed bendings 10. The two bendings 10 converge in the longitudinal direction of the boom segment 4*a* and in the area of the boom tip 16. FIG. 10 shows that the bendings 10 arranged in the web plates 8 have a V-shaped profile cross-section. This profile cross-section, which is easy to produce, effectively prevents the formation of distortions in the sheet metal section 9 of boom segment 4*a*, which forms the web plate 8. As can be seen, the bending radius of the V-shaped profile cross-section is small.

LIST OF REFERENCE SIGNS

1 articulated boom
2 large manipulator
3 articulated joint
4 4*a* boom segment
5 box profile
6 upper belt
7 lower belt
8 web plate
9 sheet metal section (thin)
10 bending
11 end
12 sheet metal section (thick)
13 transition
14 chassis
15 end hose holder
16 boom tip
17 end hose
18 cross-bending

What is claimed is:

1. Method for producing a distal boom segment of an articulated boom of a large manipulator wherein a box profile is produced by welding an upper belt and a lower belt to lateral web plates, wherein before welding the upper belt, lower belt and web plates, at least one bending running essentially in the longitudinal direction of the distal boom segment is introduced into at least one sheet metal section of the upper belt, lower belt and/or web plates, wherein the at least one bending ends at a distance from an end of the sheet metal section so that the end of the sheet metal section is unbent, wherein the at least one sheet metal section comprises a first sheet metal section and a second sheet metal section, the first sheet metal section having a first thickness, the second sheet metal section having a second thickness that is greater than the first thickness.

2. Method according to claim 1, wherein the at least one bending is introduced by a forming process.

3. Articulated boom of a large manipulator having a plurality of boom segments connected to one another via articulated joints, wherein a distal boom segment of the plurality of the boom segments comprises a welded assembly forming a box profile in which an upper belt and a lower belt are connected to one another via lateral web plates with respective welds, wherein at least one of the web plates and/or the upper belt and/or the lower belt is formed at least by one sheet metal section which has at least one bending running essentially in a longitudinal direction of the boom segment, wherein the at least one bending ends at a distance from an end of the sheet metal section so that the end of the sheet metal section is unbent, wherein at least one of the web plates and/or the upper belt and/or the lower belt comprises a first sheet metal section and a second sheet metal section, the first sheet metal section having a first thickness, the second sheet metal section having a second thickness that is greater than the first thickness, wherein the first sheet metal section and the second sheet metal section are connected to one another at a transition, wherein the first sheet metal section comprises a bending running along a longitudinal direction of the distal boom segment.

4. Articulated boom according to claim 3, wherein the at least one bending has a V-shaped profile cross-section.

5. Articulated boom according to claim 3, wherein the at least one bending has an arc-shaped profile cross-section.

6. Articulated boom according to claim 3, wherein the at least one bending is directed into an interior of the box profile or outwards out of the box profile.

7. Articulated boom according to claim 3, wherein the first sheet metal section has at least two bendings extending substantially in the longitudinal direction of the distal boom segment.

8. Articulated boom according to claim 7, wherein the at least two bendings are aligned converging along the longitudinal direction of the distal boom segment.

9. Articulated boom according to claim 7, wherein the at least two bendings are each directed in an interior of the box profile or each directed outwardly out of the box profile, or in that of the at least two bendings at least one is directed in the interior of the box profile and at least one is directed outwardly out of the box profile.

10. Articulated boom according to claim 3, wherein a profile angle (a) of the box profile is formed in the region of the at least one bending between one of the web plates and the upper belt and/or between one of the web plates and the lower belt, offset to a right angle between 2 and 15 degrees.

11. Articulated boom according to claim 3, wherein the first sheet metal section forms one of the web plates of the distal boom segment from the transition up to an end hose holder at a boom tip.

12. Articulated boom according to claim 3, wherein the first thickness is 2 millimeters.

13. Articulated boom according to claim 12, wherein the second thickness is 3-12 millimeters.

14. Articulated boom according to claim 12, wherein the second thickness is 3 millimeters.

* * * * *